US011346246B2

(12) United States Patent
Holland et al.

(10) Patent No.: US 11,346,246 B2
(45) Date of Patent: May 31, 2022

(54) BRAZED IN HEAT TRANSFER FEATURE FOR COOLED TURBINE COMPONENTS

(71) Applicant: Siemens Energy, Inc., Orlando, FL (US)

(72) Inventors: Stephen Erick Holland, Oviedo, FL (US); Veronica Arocho Pettit, Winter Springs, FL (US); Matthew H. Lang, Orlando, FL (US); Andrew Medla, Oviedo, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 0 days.

(21) Appl. No.: 16/767,133

(22) PCT Filed: Dec. 1, 2017

(86) PCT No.: PCT/US2017/064133
§ 371 (c)(1),
(2) Date: May 27, 2020

(87) PCT Pub. No.: WO2019/108216
PCT Pub. Date: Jun. 9, 2019

(65) Prior Publication Data
US 2020/0392865 A1 Dec. 17, 2020

(51) Int. Cl.
*F01D 5/18* (2006.01)
*F01D 25/12* (2006.01)

(52) U.S. Cl.
CPC ..... *F01D 25/12* (2013.01); *F01D 5/18* (2013.01); *F01D 5/188* (2013.01); *F01D 5/189* (2013.01);
(Continued)

(58) Field of Classification Search
CPC ..... F01D 5/186; F01D 5/187; F01D 5/188; F01D 5/189; F01D 25/12
See application file for complete search history.

(56) References Cited

U.S. PATENT DOCUMENTS 2,873,944 A * 2/1959 Wiese ..... F01D 5/189 416/92
2,994,124 A * 8/1961 Denny ..... B32B 15/01 428/557
(Continued)

FOREIGN PATENT DOCUMENTS

EP 0091799 A2 10/1983
EP 1149982 A2 10/2001
(Continued)

OTHER PUBLICATIONS

PCT International Search Report and Written Opinion of International Searching Authority dated Jul. 30, 2018 corresponding to PCT International Application No. PCT/2017/064133 filed Dec. 1, 2017.

*Primary Examiner* — Woody A Lee, Jr.
*Assistant Examiner* — Behnoush Haghighian

(57) ABSTRACT

A cooled turbine component in a turbine engine is provided. The cooled turbine component includes a brazed in heat transfer feature, the brazed in heat transfer feature including a thin film including a heat transfer feature incorporated into a surface of the film. The thin film is capable of conforming to a surface of the cooled turbine component and is attached to the surface of the cooled turbine component via a braze material. A method for cooling a turbine component in a turbine engine is also provided.

9 Claims, 2 Drawing Sheets

(52) U.S. Cl.
CPC .... *F05D 2220/32* (2013.01); *F05D 2230/237* (2013.01); *F05D 2260/22141* (2013.01)

(56) References Cited

U.S. PATENT DOCUMENTS

| | | | | |
|---|---|---|---|---|
| 3,700,348 | A * | 10/1972 | Corsmeier | F01D 5/189 416/90 R |
| 3,836,282 | A * | 9/1974 | Mandelbaum | F01D 9/042 415/209.4 |
| 3,966,357 | A * | 6/1976 | Corsmeier | F01D 5/189 416/97 R |
| 3,973,874 | A * | 8/1976 | Corsmeier | F01D 5/189 416/97 A |
| 4,026,659 | A | 5/1977 | Freeman | |
| 4,153,386 | A * | 5/1979 | Leogrande | F01D 5/188 415/115 |
| 4,218,179 | A * | 8/1980 | Barry | F01D 5/189 415/114 |
| 4,519,745 | A * | 5/1985 | Rosman | F01D 5/284 416/241 B |
| 5,361,828 | A | 11/1994 | Lee et al. | |
| 6,514,046 | B1 * | 2/2003 | Morrison | F01D 9/02 416/229 A |
| 6,530,745 | B2 | 3/2003 | Ciani | |
| 7,452,189 | B2 * | 11/2008 | Shi | F01D 5/282 416/226 |
| 8,092,175 | B2 * | 1/2012 | Beeck | F02C 3/16 416/95 |
| 8,292,580 | B2 * | 10/2012 | Schiavo | F01D 5/189 416/96 A |
| 8,777,569 | B1 * | 7/2014 | Liang | F01D 5/188 416/96 A |
| 9,528,382 | B2 * | 12/2016 | Morgan | F01D 5/288 |
| 9,550,198 | B2 * | 1/2017 | Reynolds | F23C 7/004 |
| 10,247,010 | B2 * | 4/2019 | Arrell | F01D 25/005 |
| 10,408,073 | B2 * | 9/2019 | Groves, II | F01D 9/065 |
| 10,794,289 | B2 * | 10/2020 | Groves, II | F01D 5/186 |
| 2002/0028133 | A1 | 3/2002 | Manzoori et al. | |
| 2011/0079635 | A1 * | 4/2011 | Dumm | B23K 1/018 228/264 |
| 2011/0110790 | A1 * | 5/2011 | Itzel | F01D 5/187 416/97 R |
| 2011/0123351 | A1 | 5/2011 | Hada et al. | |
| 2011/0200430 | A1 * | 8/2011 | Burdgick | F01D 9/044 415/209.3 |
| 2011/0255956 | A1 * | 10/2011 | Ahmad | F01D 5/189 415/115 |
| 2012/0082790 | A1 * | 4/2012 | Reynolds | C23C 14/042 427/259 |
| 2014/0093379 | A1 * | 4/2014 | Tibbott | F01D 5/189 416/224 |
| 2015/0267557 | A1 * | 9/2015 | Facchinetti | F01D 5/147 416/95 |
| 2016/0090845 | A1 * | 3/2016 | Shuck | B23K 26/32 416/95 |
| 2017/0145833 | A1 * | 5/2017 | Thornton | F01D 25/12 |
| 2018/0065337 | A1 * | 3/2018 | Grasso | B32B 15/04 |

FOREIGN PATENT DOCUMENTS

| | | | |
|---|---|---|---|
| EP | 1284338 | A2 | 2/2003 |
| EP | 1956192 | A2 | 8/2008 |
| EP | 3118420 | A1 | 1/2017 |
| GB | 2365932 | A | 2/2002 |
| JP | WO2010131385 | A1 | 11/2012 |
| RU | 2286464 | C2 | 10/2006 |
| WO | 2015023338 | A2 | 2/2015 |

* cited by examiner

BRAZED IN HEAT TRANSFER FEATURE FOR COOLED TURBINE COMPONENTS

BACKGROUND

1. Field

The present application relates generally to gas turbines, and more particularly to a brazed in heat transfer feature for cooled turbine components.

2. Description of the Related Art

Hot gas path components, such as blades and vanes of gas turbine engines, are typically exposed to high thermal loads during gas turbine operation. A flow of a hot gas is generated when a mixture of compressed air and a fuel are ignited in a combustor section of the gas turbine. The hot gas flows into the turbine section, which includes the blades and vanes. The temperatures to which the blades and vanes are exposed due to the flow of hot gas may be upwards of 450° C. and possibly even as high as 1400-1600° C. in the flow path.

The heat transfer rate and cooling effectiveness between cooling fluids and hot gas path components in a gas turbine engine directly correlates to the overall efficiency of the gas turbine. The more efficiently that heat is removed from the component, the higher the overall efficiency that can be achieved.

Various conventional methods are used to cool hot gas path components. Cast in heat transfer features, impingement cooling of backside hot gas path surfaces, and multi-circuit cooling passages are some of the methods in use to improve hot component cooling.

A gas turbine component's ability to transfer heat away from itself is particularly important due to the high operating temperatures of the engine. One way to enhance the cooling capability is to increase the component's surface area through the incorporation of heat transfer features. The incorporation of heat transfer features within hot gas path components is typically limited by available casting technologies. Additionally, the features that can be cast into the component add considerable cost and complexity to the casting process.

Consequently, a more versatile and inexpensive heat transfer feature and method to incorporate heat transfer features onto gas turbine hot gas components over the current casting process is desired.

SUMMARY

Briefly described, aspects of the present disclosure relates to a cooled turbine component in a turbine engine and A cooled turbine component in a turbine engine is provided. The turbine component is one which requires cooling at least during operation of the turbine engine. The cooled turbine component includes a brazed in heat transfer feature, the heat transfer feature comprising a thin film including a heat transfer feature incorporated into a surface of the thin film. The thin film is capable of conforming to a surface of the cooled turbine component. The film is attached to the surface of the cooled turbine component via a braze material.

A cooled turbine vane assembly is provided. The cooled turbine vane assembly includes a turbine vane in a turbine engine comprising an elongated hollow airfoil, the airfoil including an outer wall and an inner wall requiring cooling at least during operation of the turbine engine and a vane insert inserted into a hollow pocket of the airfoil and fixed to the inner wall. A thin film including a heat transfer feature incorporated into a surface of the film is attached to the surface of the turbine vane via a braze material, the thin film conforming to a surface of the turbine vane. The heat transfer feature directs a flow of air to the exterior of the turbine vane in order to improve the heat transfer from the turbine vane.

A method for cooling a turbine component in a turbine engine is provided. The method includes providing a turbine component having a component surface and then brazing a thin film comprising a heat transfer feature on the component surface via a braze material. The heat transfer feature captures heat generated during turbine operation when the turbine component is exposed to a flow of a hot gas thereby cooling the turbine component.

DETAILED DESCRIPTION

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Brazing may be defined as a process that produces a coalescence of two or more materials by heating them to a temperature in the presence of a filler material, the filler material having a lower melting point than the materials to be joined. Thus, the filler liquidates at a lower temperature than the materials to be joined adequately covering the mating surfaces of said materials in order to form a permanent bond. In contrast to welding, brazing allows bonding with the surface of another material without melting the base metal. The ability to braze onto high temperature components has improved significantly in recent years making brazing a more ideal way to incorporate heat transfer features onto a cooled turbine component. For example, the materials that one can braze with have increased such as improved powder compositions with filler materials. Brazing performs well for high temperature components as the melting point of a filler material may be well below that of the high temperature component which, in the case of high temperature components such as superalloy materials, it may be beneficial not to melt the component so that the integrity of the base metal of the high temperature component is maintained.

Figure 1:
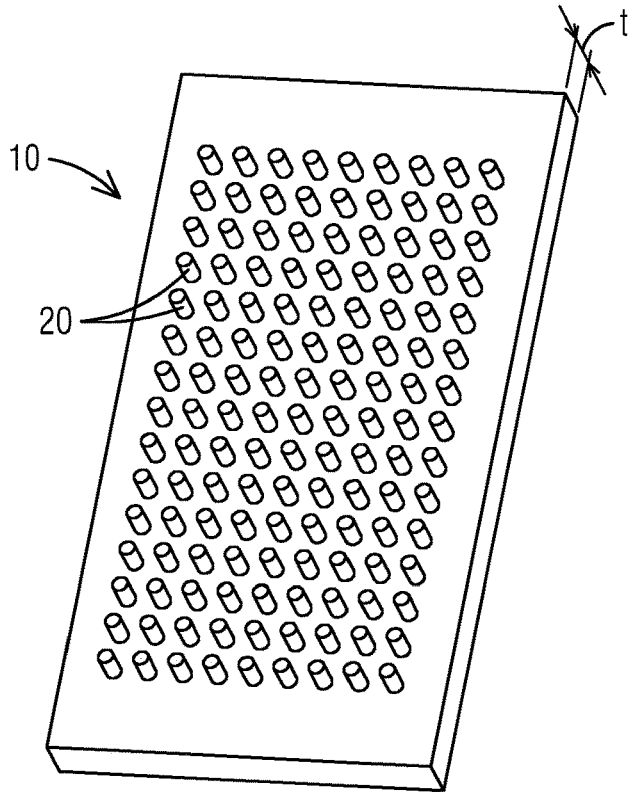
FIG. 1 illustrates an embodiment of a thin film including heat transfer features.

Referring now to the figures, where the showings are for purposes of illustrating embodiments of the subject matter herein only and not for limiting the same, FIG. 1 illustrates an embodiment of a thin film 10 or sheet in which a plurality of heat transfer features 20 are incorporated. The thin film 10 including the heat transfer features 20 may be utilized for cooling of a component. The component may be a gas turbine component, for example, which is exposed to a flow of hot gases during turbine operation. In an embodiment, the film 10 may be capable of conforming to a surface of the component. Attaching the thin film 10 to a surface of the component may be accomplished via a braze process.

The thickness (t) of the film, which distinguishes the film as a thin film, is the thickness which allows the thin film to be flexible enough to conform to the surface to which it is being attached. The film thickness (t) will vary with the stiffness of the surface material of the component, the minimum braze thickness needed for bonding, and the geometry of the surface the film is being bonded to. The film thickness (t), measuring from the base of the heat transfer features to the surface of the component, may lie in a range of 0.1-5 mm. These thicknesses are for exemplary purposes only and are not meant to be limiting.

In the illustrated embodiment, the plurality of heat transfer feature(s) 20 includes a pin-shape and are formed into an array on the surface of the film 10. However, the heat transfer features 20 may be a variety of shapes according to the cooling requirements of a component onto which the film 10 may be attached. For example, the shape of the heat transfer feature(s) may include pins, waves, chevrons, spikes, ribs, and fins. These listed shapes are for exemplary purposes only and are not meant to be limiting.

Because the film 10 including the heat transfer feature 20 is a separate component and attached to, as opposed to cast into, the component, the heat transfer feature 20 may be customized for the particular component it will be attached to and the cooling requirements of the component. Additionally, interchanging the brazed film with the heat transfer feature is relatively easy, for example by simply removing the thin film 10 from the turbine component. Having this capability, the heat transfer feature 20, may be optimized for the design of the turbine component and operating environment to which the turbine component is exposed.

The optimization of the heat transfer feature 20 may be accomplished using a variety of means, only a few of which will be discussed here. In an embodiment, the optimization may take the form of varying the shape and/or size of the heat transfer feature 20. For example, a single heat transfer feature 20 or a plurality of heat transfer features 20 may be incorporated onto the thin film 10. The shape of the heat transfer feature 20 may be selected from various shapes. In addition to the shapes discussed above, one skilled in the art would understand that a multitude of other shapes and sizes may be available for the optimization of the heat transfer feature. In another embodiment, the spacing between the plurality may be varied. In a further embodiment, the material of the thin film 10 may be varied according to the design requirements of the component onto which the thin film 10 will be attached. In a further embodiment, the location of the heat transfer feature on the thin film 10 may be varied to optimize the heat transfer of the turbine component.

In an embodiment, the cooled turbine component may be a turbine component such as blade, vane, or vane insert. However, the cooled turbine component may also be other turbine components such as a ring segment, combustion basket, combustion transition, etc. Vane inserts may be fixed to an inner surface of a hollow vane airfoil in order to facilitate the cooling of the vane.

Figure 3:
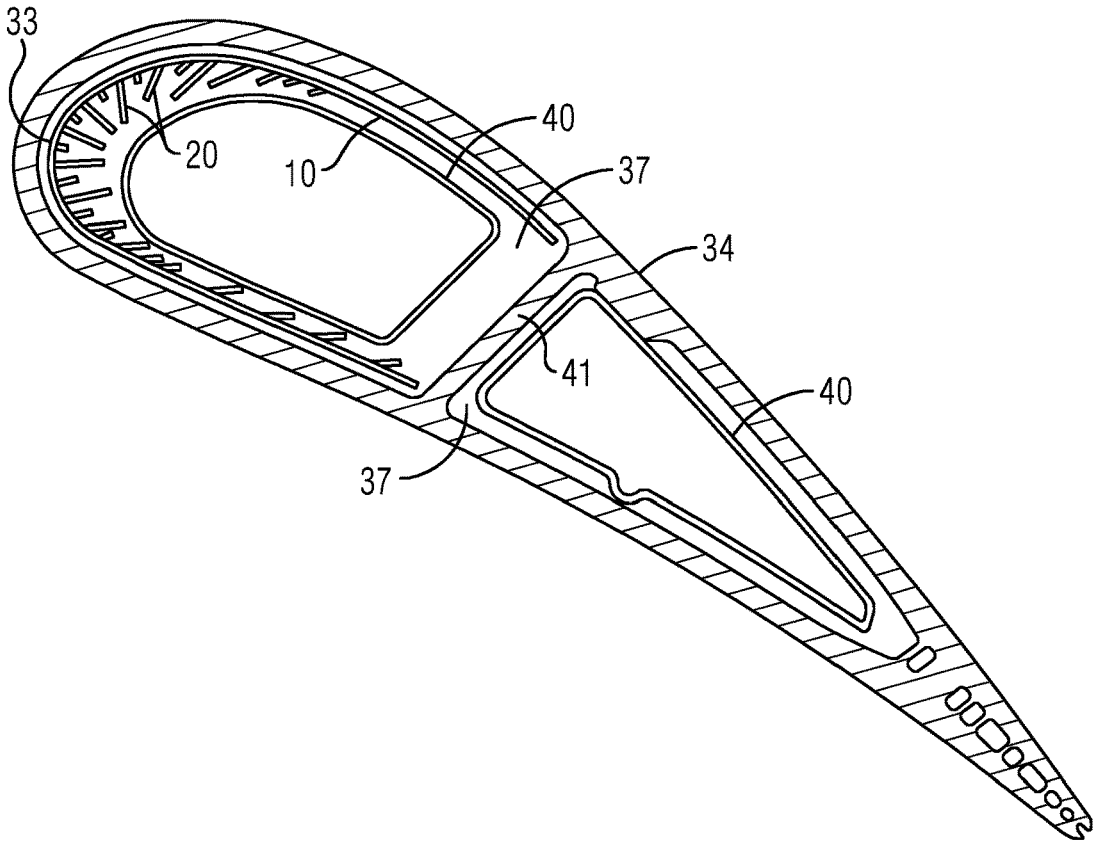
FIG. 3 illustrates a cross section of a vane including an embodiment of a thin film including heat transfer features.
Figure 2:
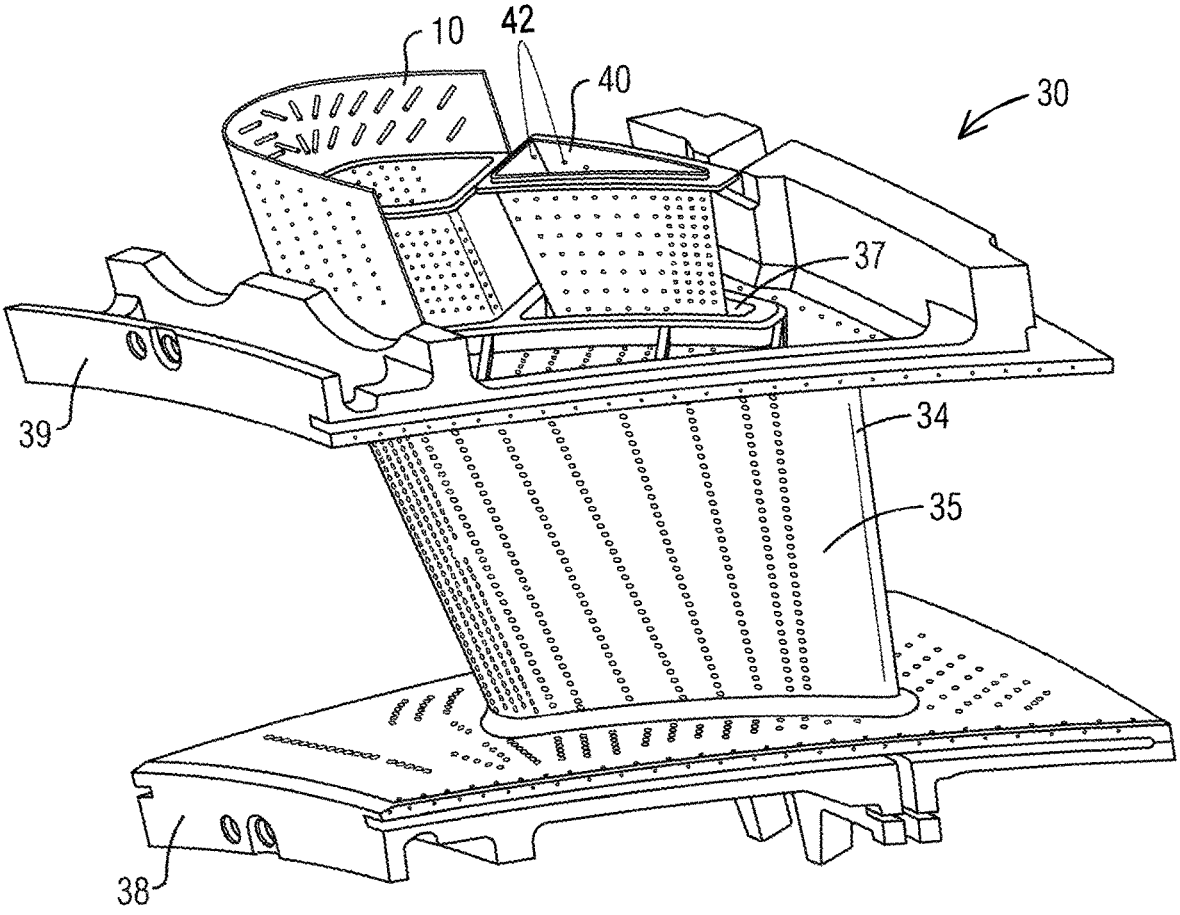
FIG. 2 illustrates a perspective view of a vane assembly including a vane insert.

Referring to FIG. 2, a turbine component for a gas turbine engine is shown in the form of a stationary turbine vane 30. The vane 30 includes an elongated airfoil having a body 35 with an outer wall 34 and an inner wall 33 (FIG. 3). The vane 30 may also include an outer shroud 39 at a first end of the vane 30 and an inner shroud 38, also known as a platform, at a second end of the vane 30. The vane 30 may be configured for use in a gas turbine engine. The body 35 of the vane may define one or more hollow pockets 37 to allow for a cooling fluid to flow therethrough for cooling of the vane 30. The illustrated vane 30 includes a vane insert 40 in accordance with an embodiment. For ease of description, it is appreciated that although the singular term 'insert' is used, the term 'insert' may refer to one or more inserts. The insert 40 may be inserted into a hollow pocket 37 on the interior of the vane 30 as illustrated. In the embodiment shown in FIG. 2, the thin film 10 will be attached to the inner wall 33 of the vane 30. In an alternate embodiment, the thin sheet 10 may be attached via a braze to an outer surface of the vane insert 40 across from the inner wall 33 of the vane.

FIG. 3 shows a cross-sectional view of the airfoil 35 of the vane shown in FIG. 2. As shown, the body of the airfoil 35 includes an outer wall 34 and an inner wall 33. Two hollow pockets 37 are shown in the interior of the vane separate by a rib 41. Vane inserts 40 may be inserted, as shown, into these hollow pockets 37. FIG. 3 also depicts a thin film 10 attached to a surface of the inner wall 33 of the vane 30 between the vane 30 and the insert 40. The thin film 10 may be attached to the inner wall 33 via a braze material. In the shown embodiment, the thin film 10 conforms to the surface of the curved inner wall 33 of the vane. The heat transfer feature 20 incorporated onto the thin film 10 is depicted as spikes of various heights from a surface of the thin film 10 extending into the interior of the hollow pocket 37. During turbine operation, air flowing through the hollow pockets 37 is directed to an outer portion of the vane 30 by the heat transfer features 20 in order to improve the heat transfer of the vane 30. In an embodiment, the vane insert 40 includes a plurality of holes 42, the plurality of holes 42 directing the flow of air across the heat transfer features 20 of the thin film 10.

In an embodiment, the thin film 10 may be any material that may be formed in a sheet. In another embodiment, the thin film 10 may be a material that is the same material or a similar material as that of a cooled turbine component, such as a turbine blade or vane. Cooled turbine components may be formed from a superalloy or nickel-based alloy, such as CM 247, IN939, IN617, IN735, IN718, IN625, Haynes282, Haynes 230, Hast-X, and Hast-W. More generally, any material that can be brazed may be used for the cooled turbine component. Thus, by brazing in the heat transfer features 20 onto the turbine component 30, 40 to be cooled, the type of material used for the heat transfer feature 20 may be varied depending on the thermal conductivity of the heat transfer feature 20.

In an embodiment, the braze mixture including both the parent material to be joined and the filler material may include ratios of high melt parent material to low melt constituents. Some low melt constituents that may be used are Amdry™775, Co22, Co33, Bf4B, and BRB. The high melt to low melt values may vary from 10/90 (in wt. %) mixtures up to and including 90/10 (in wt. %) mixtures. The high melt to low melt values may vary from 10/90 (in wt. %) mixtures up to and including 90/10 (in wt. %) mixtures.

In an embodiment, the thin film 10 may be formed by various processes including welding heat transfer features 20 on a sheet of material, additive manufacturing, rolling, stamping, machining, water jetting, laser machining, convention machining, and non-conventional machining (Electrical Discharge Machining (EDM), Electro-Chemical Machining (ECM)) and casting the thin film 10 with the incorporated features.

Referring to FIGS. 1-3, a method for cooling a turbine component 30, 40 is also provided. The method includes the steps of providing a turbine component 30, 40 having a component surface as described above. A thin film 10 including a heat transfer feature 20 is brazed onto the turbine component surface via a braze process. The heat transfer feature 20 captures heat generated during gas turbine operation when the turbine component 30, 40 is exposed to a flow of a hot gas thereby cooling the turbine component 30, 40.

In addition to the proposed means to optimize the thin film 10 including the heat transfer feature 20 as described above, the heat transfer feature 20 may be optimized according to the velocity of the hot gas flow and the temperature of the hot gas flow around the turbine component 30, 40.

In an embodiment, the proposed method may be utilized to retrofit an existing installed turbine component 30, 40. For example, in order to add heat transfer features 20 to a turbine component 30, 40 already installed in a gas turbine, the component 30, 40 may only need to be removed and the method performed on the turbine component in order to enhance the turbine component by adding heat transfer features optimized for the particular turbine component and the specific operating conditions the turbine component will be exposed to during turbine operation.

In a further embodiment, the proposed method may be used to interchange a currently brazed thin sheet 10 on a turbine component 30, 40 with another thin sheet having different heat transfer features 20 than the current one. The interchange may be accomplished by first removing the currently brazed thin sheet 10. Removing the currently brazed thin sheet 10 may entail heat treating the brazed thin sheet 10 in which the braze melts while the thin sheet material does not. The heat treatment chosen will be based on the particular filler material and component material used. The temperature for the heat treatment will be above the original brazing temperature. The thin sheet 10 may then be removed from the turbine component 30, 40. Another brazed thin sheet 10 having different heat transfer features 20 may then be brazed onto the turbine component 30, 40 according to the proposed method.

The proposed component and method offer the advantage of improved heat transfer capability of the component by the ability of optimizing the heat transfer features for the cooling requirements of the particular turbine component. Because the heat transfer features are not permanently cast into the component, the heat transfer features may be changed as the cooling requirements change, for example. Additionally, existing components may be retrofit with the brazed film during repair. Furthermore, brazing the heat transfer features onto the turbine component instead of casting is a more inexpensive option for the incorporation of heat transfer features onto a turbine component.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A cooled turbine vane in a turbine engine, comprising:

a turbine vane comprising an elongated hollow airfoil, the airfoil including an outer wall and an inner wall, the turbine vane requiring cooling at least during operation of the turbine engine;

a vane insert inserted into a hollow pocket of the airfoil and attached to a platform of the turbine vane; and a thin film having a first surface and a second surface opposite the first surface and including at least one heat transfer feature incorporated into the second surface of the film, the film conforming to a surface of the inner wall of the cooled turbine vane, wherein the first surface is attached to the surface of the inner wall via a braze material so that the film is between the turbine vane and the vane insert, wherein the vane insert includes a plurality of holes directing a flow of air across the heat transfer feature of the thin film, wherein the heat transfer feature extends from the second surface towards the interior of the hollow pocket of the airfoil.

2. The cooled turbine vane as claimed in claim 1, wherein the at least one heat transfer feature is a plurality of heat transfer features.

3. The cooled turbine vane as claimed in claim 1, wherein the shape of the heat transfer feature is selected from the group consisting of pins, waves, chevrons, spikes, ribs, and fins.

4. The cooled turbine vane as claimed in claim 1, wherein the thin film including the heat transfer feature is formed by a process selected from the group consisting of additive manufacturing, welding, casting, rolling, stamping, machining, water jetting, and conventional machining, non-conventional machining, and laser machining.

5. The cooled turbine vane as claimed in claim 1, wherein a thickness of the thin film is in a range of 0.1 mm to 5 mm.

6. The cooled turbine vane as claimed in claim 2, wherein the plurality of heat transfer features is formed in an array on the surface of the film.

7. A method for cooling a turbine component in a turbine engine, comprising:

disposing a turbine vane in the turbine engine, the turbine vane comprising an elongated hollow airfoil, the airfoil having an outer wall and an inner wall requiring cooling at least during operation of the turbine engine;

inserting a vane insert into a hollow pocket of the airfoil, fixed to the inner wall and attached to a platform of the turbine vane;

brazing a first surface of a thin film having the first surface and a second surface opposite the first surface and comprising a heat transfer feature on the surface of the inner wall via a braze material; and directing a flow of air, by a plurality of holes included in the vane insert, across the heat transfer feature of the thin film, wherein the heat transfer feature captures heat generated during turbine operation when the turbine vane is exposed to a flow of a hot gas, thereby cooling the turbine vane, and wherein the heat transfer feature extends from the second surface towards the interior of the hollow pocket of the airfoil.

8. The method as claimed in claim 7, wherein the method is performed to retrofit the thin film onto an installed turbine vane.

9. The method as claimed in claim 7, further comprising removing the brazed film from the turbine vane by heat treating the existing brazed film and replacing the removed brazed film with a further thin film via brazing.

* * * * *